US009587402B2

(12) United States Patent
Freeman

(10) Patent No.: US 9,587,402 B2
(45) **Date of Patent: *Mar. 7, 2017**

(54) PROTECTED MEMBRANE ROOF SYSTEM

(71) Applicant: Thurman W. Freeman, Newark, OH (US)

(72) Inventor: Thurman W. Freeman, Newark, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/775,275

(22) PCT Filed: Mar. 12, 2014

(86) PCT No.: PCT/US2014/024763

§ 371 (c)(1),
(2) Date: Sep. 11, 2015

(87) PCT Pub. No.: WO2014/165199

PCT Pub. Date: Oct. 9, 2014

(65) Prior Publication Data

US 2016/0024795 A1 Jan. 28, 2016

Related U.S. Application Data

(63) Continuation of application No. 13/798,810, filed on Mar. 13, 2013, now Pat. No. 8,863,442.

(51) Int. Cl.
*E04B 7/00* (2006.01)
*E04D 11/02* (2006.01)
(Continued)

(52) U.S. Cl.
CPC ..... *E04D 11/02* (2013.01); *E04B 7/22* (2013.01); *E04D 3/354* (2013.01); *E04D 3/3605* (2013.01);
(Continued)

(58) Field of Classification Search
CPC ..... E04D 11/02; E04D 3/3605; E04D 3/3607; E04D 3/354; E04D 12/002; E04D 7/00; E04D 13/1662; E04D 5/145; E04B 7/22
(Continued)

(56) References Cited

U.S. PATENT DOCUMENTS 3,103,042 A 9/1963 Martin
3,135,069 A * 6/1964 Schuller ..... E04D 5/12 428/139
(Continued)

FOREIGN PATENT DOCUMENTS

WO 2011130494 A1 10/2011

OTHER PUBLICATIONS

Freeman System Hydrotech Garden Roof Assembly.
International Search Report and Written Opinion PCT/US2014/024763, mailed Aug. 20, 2014.

*Primary Examiner* — Basil Katcheves
*Assistant Examiner* — Joshua Ihezie
(74) *Attorney, Agent, or Firm* — Lodestone Legal Group; Jeromye V. Sartain

(57) ABSTRACT

A protected membrane roof system for installation on a roof decking comprising an upper insulation board having an upwardly-facing upper board top surface and an opposite downwardly-facing upper board bottom surface and at least one through-hole communicating therebetween, a ballast material positioned over the upper insulation board, a netting positioned over the ballast material, and at least one fastener assembly having a base seated substantially adjacent the upper board bottom surface, a rod extending substantially vertically from the base of sufficient size so as to extend through the through-hole of the upper insulation board, the ballast material, and the netting, and a cap engaged with the rod above the netting, whereby the wind uplift resistance of the protected membrane roof system is
(Continued)

improved and scour of the ballast material is reduced by effectively anchoring the netting to the upper insulation board beneath the ballast material.

21 Claims, 8 Drawing Sheets

(51) Int. Cl.

| | |
|---|---|
| ***E04D 5/14*** | (2006.01) |
| ***E04D 13/16*** | (2006.01) |
| ***E04B 7/22*** | (2006.01) |
| ***E04D 3/35*** | (2006.01) |
| ***E04D 3/36*** | (2006.01) |
| ***E04D 7/00*** | (2006.01) |
| ***E04D 12/00*** | (2006.01) |

(52) U.S. Cl.
CPC ..... *E04D 3/3607* (2013.01); *E04D 5/145* (2013.01); *E04D 7/00* (2013.01); *E04D 12/002* (2013.01); *E04D 13/1662* (2013.01)

(58) Field of Classification Search
USPC ..... 52/13, 23, 408, 409, 412
See application file for complete search history.

(56) References Cited

U.S. PATENT DOCUMENTS 3,343,227 A * 9/1967 Brown ..... E04F 13/0801 29/432
4,235,058 A * 11/1980 Patry ..... E04D 11/02 52/408
4,397,126 A 8/1983 Nelson
4,441,295 A * 4/1984 Kelly ..... E04D 3/3603 52/309.8
4,546,580 A * 10/1985 Ueno ..... E04D 11/005 52/126.1
4,557,081 A * 12/1985 Kelly ..... E04D 5/14 52/199
4,616,455 A * 10/1986 Hewison ..... E04D 3/3603 411/383
4,649,686 A * 3/1987 Backenstow ..... E04D 5/143 52/410
4,663,909 A * 5/1987 Ogino ..... E04D 11/00 454/185
4,669,246 A * 6/1987 Freeman ..... E04D 11/02 52/309.8
4,677,800 A * 7/1987 Roodvoets ..... E04D 13/172 52/199
4,706,432 A * 11/1987 Fishburn ..... E04D 5/142 277/654
4,712,349 A * 12/1987 Riley ..... E04D 11/02 52/199
4,719,723 A * 1/1988 Van Wagoner ..... E04D 11/02 52/15
4,727,699 A * 3/1988 Sargent ..... E04D 5/143 24/459
4,739,599 A * 4/1988 Lopez ..... E04D 3/3603 52/410
4,783,942 A * 11/1988 Nunley ..... E04D 13/1681 52/309.1
4,870,796 A * 10/1989 Hart ..... E04D 7/00 52/309.8
4,888,930 A * 12/1989 Kelly ..... E04D 3/3601 52/309.8
4,899,514 A * 2/1990 Brookhart, Jr. ..... E04D 11/00 52/535
4,924,174 A * 5/1990 Sheahan ..... E04D 13/006 324/696
5,144,782 A * 9/1992 Paquette ..... E04D 11/02 52/14
5,174,128 A 12/1992 Bourne et al.
5,193,326 A * 3/1993 Sheahan ..... E04D 3/3601 52/698
5,212,927 A * 5/1993 Sheahan ..... G01M 3/02 411/381
5,347,768 A * 9/1994 Pineda ..... E04B 7/02 52/23
5,579,619 A * 12/1996 Godschalx ..... E04D 5/12 52/409
5,784,845 A * 7/1998 Imeokparia ..... E04D 11/02 52/309.6
5,784,846 A 7/1998 Godschalx
5,907,938 A * 6/1999 Sheahan ..... E04D 3/3603 411/531
5,979,133 A * 11/1999 Funkhouser ..... E04D 5/10 428/353
6,179,538 B1 * 1/2001 Palm ..... E04D 3/3603 411/1
6,460,304 B1 10/2002 Kim
6,640,518 B2 11/2003 Bol
7,430,837 B2 10/2008 Hubbard
7,591,112 B2 9/2009 Verheyen
7,638,054 B1 * 12/2009 Jensen ..... C02F 3/32 210/259
7,765,757 B2 8/2010 Gembala
8,122,682 B2 2/2012 Mischo
8,287,997 B2 10/2012 Paradis et al.
8,863,442 B2 * 10/2014 Freeman ..... E04D 13/1662 52/23
2005/0147465 A1 7/2005 Tiemann et al.
2006/0174585 A1 * 8/2006 Barr ..... B32B 7/12 52/741.3
2007/0094971 A1 * 5/2007 Kern ..... F17C 3/022 52/404.1
2008/0072531 A1 3/2008 Oliveira
2009/0188172 A1 7/2009 DuCharme et al.
2010/0031603 A1 * 2/2010 Letts ..... B32B 27/40 52/745.06
2010/0126066 A1 * 5/2010 DeVos ..... E04D 11/002 47/65.9
2010/0325975 A1 * 12/2010 Mischo ..... E04D 7/005 52/173.3
2011/0197504 A1 8/2011 Hellwig
2012/0311951 A1 * 12/2012 Letts ..... E04D 3/3603 52/483.1

* cited by examiner

PROTECTED MEMBRANE ROOF SYSTEM

RELATED APPLICATIONS

This application claims priority and is entitled to the filing date of U.S. Non-Provisional application Ser. No. 13/798,810 filed Mar. 13, 2013, and entitled "Protected Membrane Roof System." The contents of the aforementioned application are incorporated herein by reference.

INCORPORATION BY REFERENCE

Applicant(s) hereby incorporate herein by reference any and all patents and published patent applications cited or referred to in this application.

TECHNICAL FIELD

Aspects of this invention relate generally to roof systems and structures, and more particularly to improved protected membrane roof systems.

BACKGROUND ART

In general and for context, a protected membrane roof ("PMR") is generally a typically flat or minimally sloped roof having one or more layers of insulation (specifically extruded polystyrene) installed over the waterproofing membrane and deck assembly. This configuration provides for protection against UV radiation, thermal shock, the elements, and physical abuse for that vital waterproofing membrane below. It is noted that conventional low-sloped roofs place the membrane on top of the insulation, while in "PMR" roof assemblies, that waterproofing membrane is typically placed directly on the structural deck (except for metal decks where a substrate board is installed first). In order to provide "ballasting" for the insulation and "PMR" roof system in general, some type of ballast material such as stones, pavers, or soil (garden roofs) or the like is applied over the insulation layer(s) for further protection of the membrane as well as protection effects for wind uplift resistance for the underlying insulation boards. To protect against scour of the ballast material, it is often preferable to apply a netting over the ballast material (i.e., soil) and now to further expand that to other types of ballast such as pavers and stones. This netting which is applied over the ballast material, either at least around a swatch of the roof perimeter or over the entire roof, is then itself susceptible to wind uplift or being blown off the roof even if staked within the ballast material. To attempt to secure the netting against wind uplift, stakes or anchors are typically applied to or secured within the ballast material itself. On information and belief, the prior art anchoring approach, though perhaps relatively easily installed and relatively inexpensive, results in significantly reduced wind uplift resistance—on the order of only two to four pounds (2-4 lbs).

What is needed is a protected membrane roof system wherein a fastener assembly is secured beneath an insulation board thereof positioned beneath the ballast material for improved wind uplift resistance. Aspects of the present invention fulfill these needs and provide further related advantages as described in the following summary.

DISCLOSURE OF INVENTION

Aspects of the present invention teach certain benefits in construction and use which give rise to the exemplary advantages described below.

The present invention solves the problems described above by providing a protected membrane roof system for installation on a roof decking comprising an upper insulation board having an upwardly-facing upper board top surface and an opposite downwardly-facing upper board bottom surface and at least one through-hole communicating therebetween, a ballast material positioned over the upper insulation board, a netting positioned over the ballast material, and at least one fastener assembly having a base seated substantially adjacent the upper board bottom surface, a rod extending substantially vertically from the base of sufficient size so as to extend through the through-hole of the upper insulation board, the ballast material, and the netting, and a cap engaged with the rod above the netting, whereby the wind uplift resistance of the protected membrane roof system is improved and scour of the ballast material is reduced by effectively anchoring the netting to the upper insulation board beneath the ballast material.

A primary objective inherent in the above described apparatus and method of use is to provide advantages not taught by the prior art.

Another objective is to provide such a system wherein the netting positioned over the ballast material is effectively anchored beneath the upper insulation board positioned beneath the ballast material.

Yet another objective is to provide such a system wherein the base of the fastener system for anchoring the netting is substantially seated within a recess formed in the upper board bottom surface.

Yet another objective is to provide such a system that enables various positioning of a waterproof membrane, including but not limited to directly over the roof decking or between the upper insulation board and an adjacent lower insulation board positioned over the roof decking.

Yet another objective is to provide such a system that allows for a variety of ballast materials.

Yet another objective is to provide such a system that allows for the selective positioning of the anchor assembly within the upper insulation board so as to extend between adjacent pavers or insulation panels defining the ballast material.

Yet another objective is to provide such a system that allows for selection of the length of the rod of the fastener assembly to account for variations in the protected membrane roof system, particularly the ballast material.

And yet another objective is to provide such a system wherein a pre-fabricated insulation board including an insulation layer having an insulation layer top surface, a facer installed on the insulation layer top surface so as to be coterminous therewith, and at least one through-hole formed in the pre-fabricated insulation board so as to pass through both the insulation layer and the facer may be employed, such as in substitution for the upper insulation board.

Other features and advantages of aspects of the present invention will become apparent from the following more detailed description, taken in conjunction with the accompanying drawings, which illustrate, by way of example, the principles of aspects of the invention.

BRIEF DESCRIPTION OF DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

MODES FOR CARRYING OUT THE INVENTION

The above described drawing figures illustrate aspects of the invention in at least one of its exemplary embodiments, which are further defined in detail in the following description.

Figure 1:
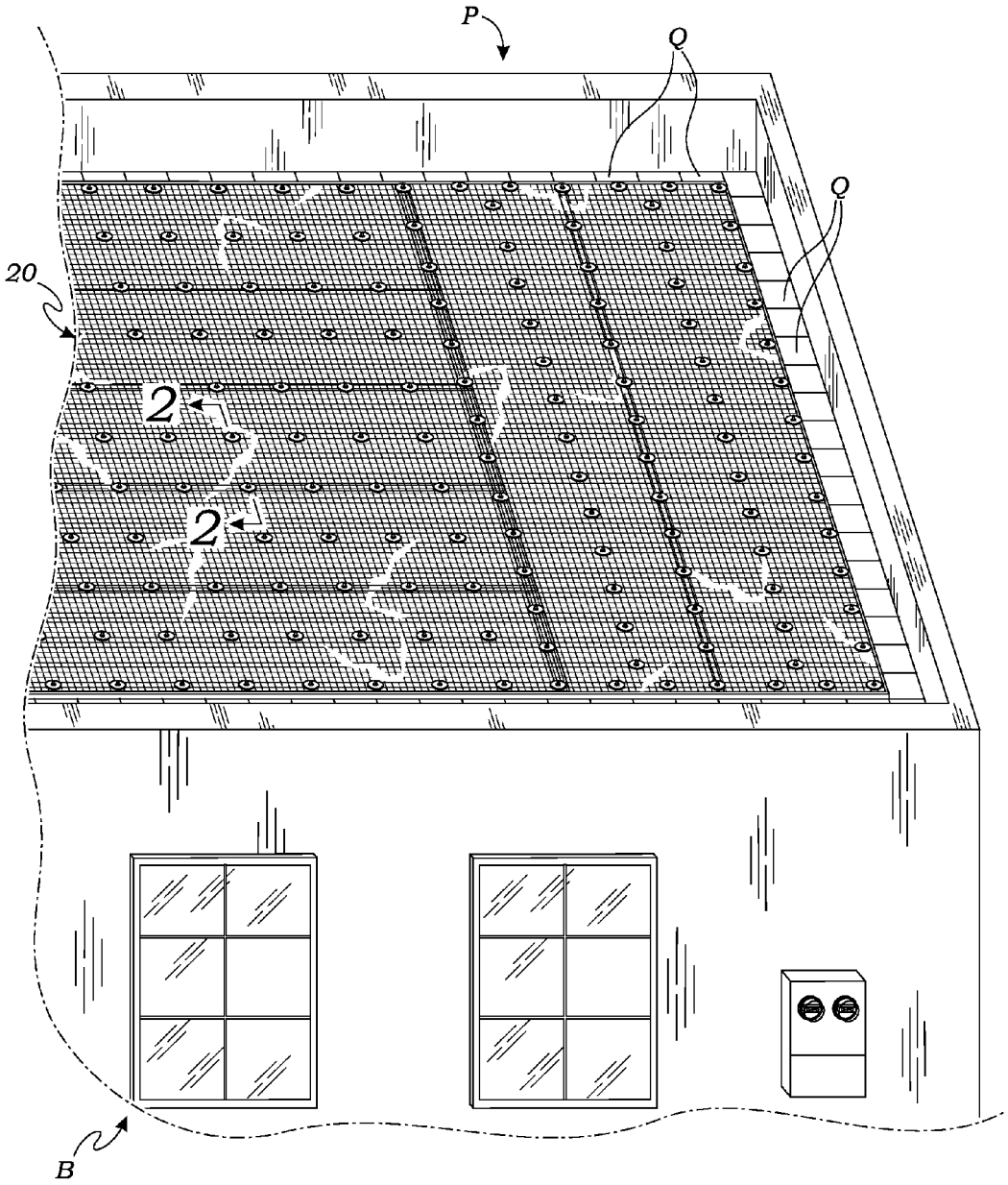
FIG. 1 is a perspective view of a first exemplary embodiment of a protected membrane roof system according to aspects of the present invention.

Turning now to FIG. 1, there is shown a "bird's eye" perspective view of an exemplary embodiment of a protected membrane roof system 20 according to aspects of the present invention. As known in the art, a protected membrane roof ("PMR") is generally a typically flat roof having one or more layers of insulation installed over the waterproofing membrane for protection against UV radiation, thermal shock, the elements, and physical abuse, whereas conventional roofs have the waterproofing membrane installed over the insulation leaving the membrane exposed to the elements. In Protected Membrane Roofs, ballast material such as soil, stones, pavers, or the like is applied over the insulation layer(s) for further insulation and protection effects as well as wind uplift resistance for the underlying insulation boards. To protect against scour of the ballast material, it is often preferable to apply a netting over the ballast material, at least around a swatch of the roof perimeter or over the entire roof, which netting is then itself susceptible to wind uplift or being blown off the roof even if staked within the ballast material. For further context, and again with reference to the illustrative protected membrane roof system 20, it is shown as being installed on a conventional flat-roofed office or industrial building B. Such buildings are commonly formed with a parapet wall P about the perimeter of the roof of the building B, essentially being an extension of the sides of the building B vertically beyond the roof decking R (FIGS. 2-7). Particularly in "garden roofs," or roofs employing vegetation and thus soil as the ballast material, the roofs typically also include vegetation free zones at the perimeters (typically 2' to 4' wide) where stone ballast or 2'×2'×2" pavers Q are utilized. While such an illustrative type of PMR system is thus described generally herein for context, it will be appreciated that the invention is not so limited and may be employed in virtually any PMR system now known or later developed having ballast materials the scour of which is to be prevented.

Figure 2:
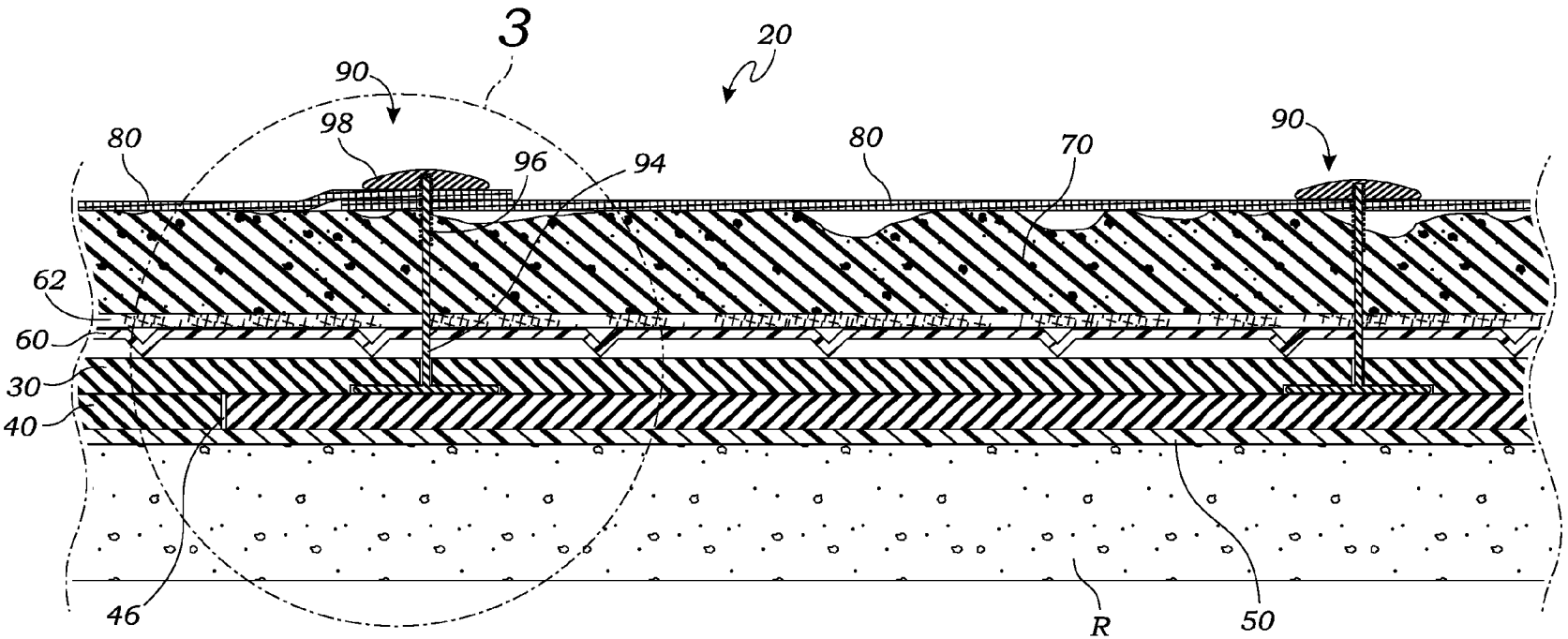
FIG. 2 is an enlarged partial cross-sectional schematic of the first exemplary embodiment thereof taken along line 2-2 of FIG. 1.
Figure 4:
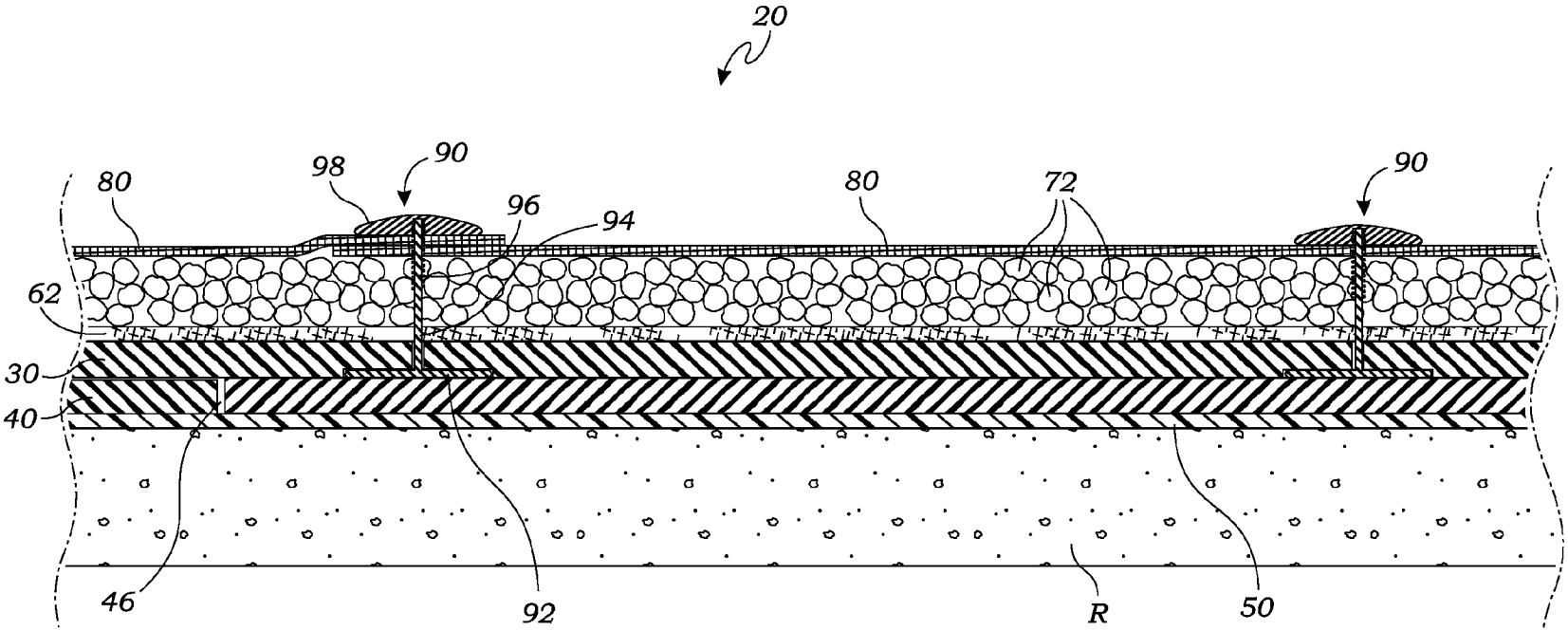
FIG. 4 is a cross-sectional schematic analogous to FIG. 2 of a second exemplary embodiment.
Figure 5:
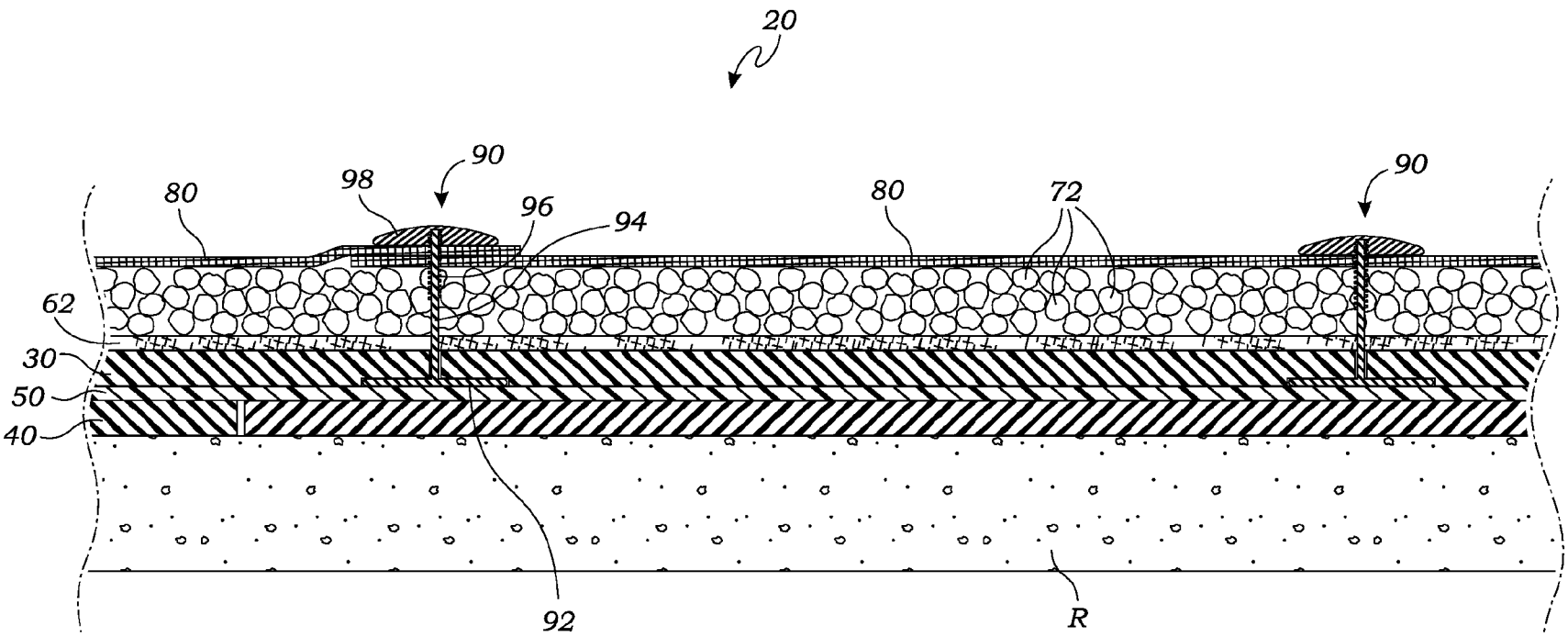
FIG. 5 is a cross-sectional schematic analogous to FIG. 2 of a third exemplary embodiment.
Figure 6:
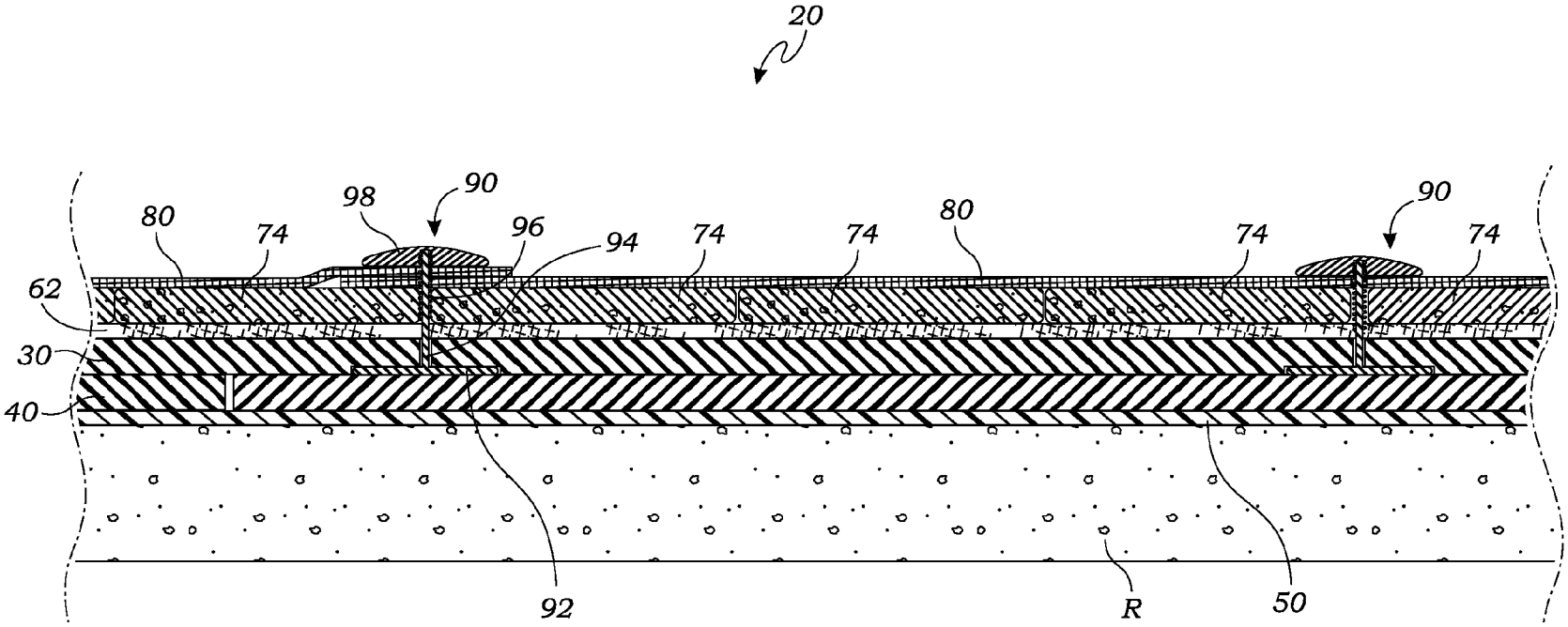
FIG. 6 is a cross-sectional schematic analogous to FIG. 2 of a fourth exemplary embodiment.
Figure 7:
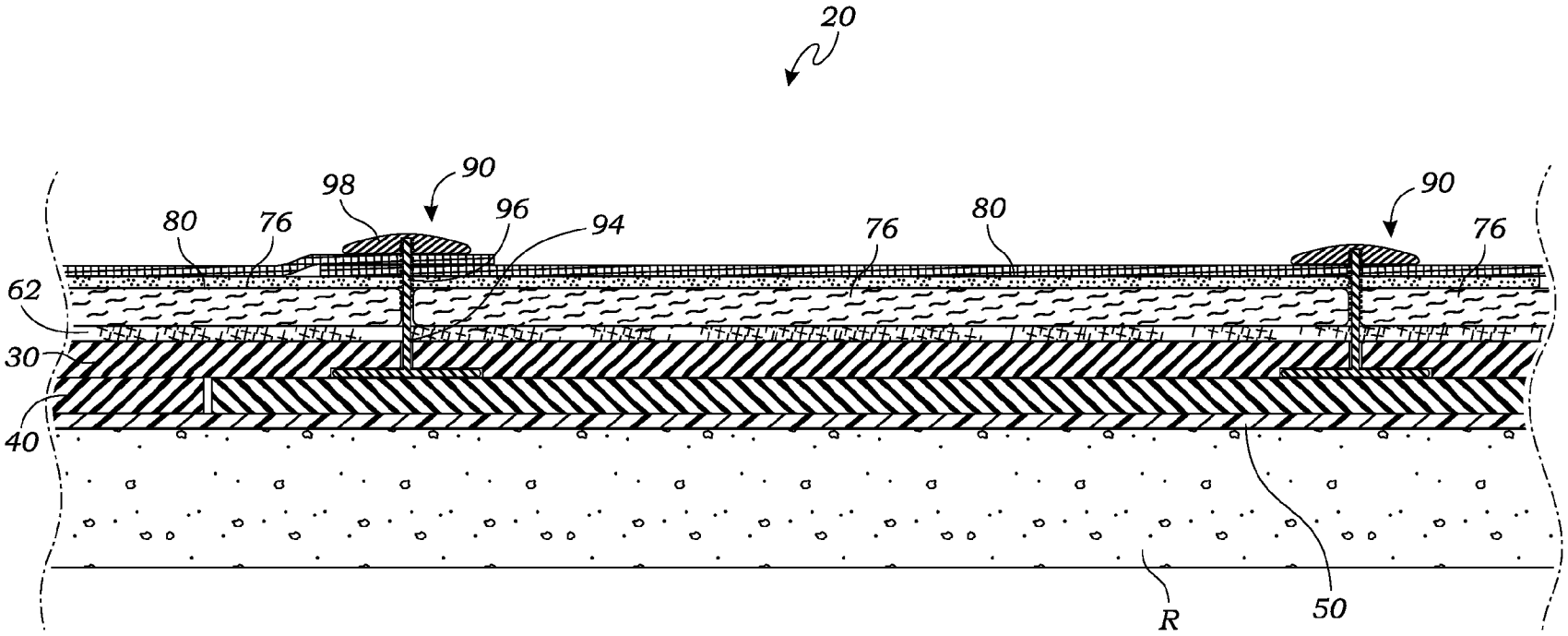
FIG. 7 is a cross-sectional schematic analogous to FIG. 2 of a fifth exemplary embodiment.

With reference now to the enlarged cross-sectional schematic of FIG. 2, a first exemplary embodiment of the protected membrane roof system 20 is shown as generally comprising over the roof decking R, from bottom to top, a waterproofing membrane 50, a lower insulation board 40, an upper insulation board 30, a drainage retention layer 60, a filter fabric layer 62, soil ballast material 70, and netting 80. At least one fastener assembly 90 is provided for securing the netting 80 over the soil ballast material 70 as described in greater detail further below. In the exemplary embodiment the joints 46 between adjacent boards 40 in the same layer of insulation are to be staggered relative to the joints in an adjacent insulation layer, such that the joints 46 in various layers are not substantially aligned. In the typical embodiment, the upper and lower insulation boards 30, 40 are formed of extruded polystyrene, typically two to six inches (2-6") thick and serving to insulate and provide dew point control, though it will be appreciated that virtually any insulation board now known or later developed as suitable for PMR systems generally, of virtually any material and thickness, may be employed in the present invention. It will be appreciated by those skilled in the art, with further reference to the alternative embodiments shown and described herein below, that while particular layered configurations of the exemplary protected membrane roof system 20 are shown and described, the invention is not so limited, but instead may involve more, fewer, or different layers in varying orders within the construction without departing from the spirit and scope of the invention, such that the exemplary embodiment of FIG. 2 and those further alternative embodiments of FIGS. 4-7 are to be understood as merely illustrative of aspects of the present invention. Specifically, and by way of further example, while soil ballast material 70 is shown in FIG. 2 the invention is not so limited, as stone ballast material 72 may be employed as shown in FIGS. 4 and 5, paver ballast material 74 as shown in FIG. 6, and insulation ballast material 76 as shown in FIG. 7, and thus the invention is not limited to any such particular ballast material but instead may involve any appropriate ballast material now known or later developed.

Figure 3:
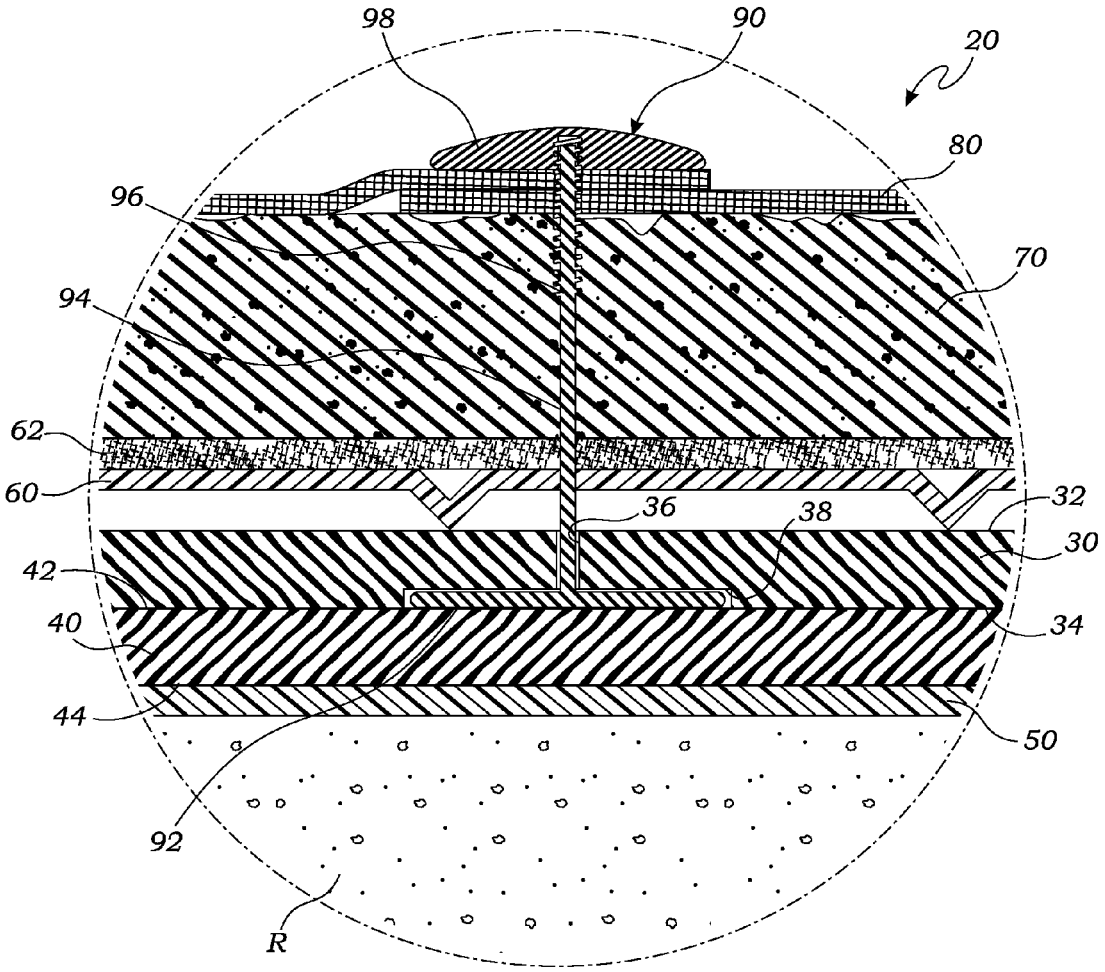
FIG. 3 is a further enlarged partial cross-sectional schematic taken from circle 3 of FIG. 2.

With continued reference to FIG. 2 and further reference to the enlarged partial cross-sectional schematic of FIG. 3, in the first exemplary embodiment of the protected membrane roof system 20, once more, at least one fastener assembly 90 is provided for securing the netting 80 over the soil ballast material 70. More particularly, in the exemplary embodiment, a base 92 of the fastener assembly 90 is positioned beneath the upper insulation board 30, basically substantially trapped between the upper board bottom surface 34 and the lower board top surface 42. As shown, the base 92 is substantially embedded in the upper board bottom surface 34 within a recess 38, though it will be appreciated that it could potentially be embedded in the lower board top surface 42, or some combination of the two, depending on the type of insulation material employed in each board 30, 40 and the treatment of any of the surfaces thereof, and thus how conforming the surfaces of each board 30, 40 might be, as well as the hardness, shape and thickness of the base 92 itself. As such, the recess 38 may be pre-formed in the upper board bottom surface 34 or may be formed therein during the assembly of the protected membrane roof system 20 essentially by the compressive forces acting on the system 20, again depending on the properties of the insulation boards 30, 40 and other factors. Or based on the relative flexibility of the insulation boards 30, 40 and/or the base 92 being sufficiently thin, no such recess 38 may be formed at all in some embodiments while still allowing the fastener assembly 90 to be anchored beneath the upper insulation board 30 and the insulation boards 30, 40 to still be substantially flush upon installation. As such, those skilled in the art will appreciate that the recess 38 may be formed, if at all, on a number of surfaces or in a number of locations and through a variety of means without departing from the spirit and scope of the invention. The base 92 is configured having a rod 94 extending substantially vertically therefrom, which rod 94 may be integral with the base 92 or removably engaged therewith, more about which is said below in connection with alternate embodiments of the system 20. Wherever the fastener assembly 90 is to be placed, and again whether or not a recess 38 is there pre-formed, as the base 92 is seated substantially against or adjacent the upper board bottom surface 34, the rod 94 that extends from the base 92 is to pass through the upper insulation board 30 and out its top surface 32. It will be appreciated that such a through-hole 36 through which the rod 94 passes may further be pre-formed, particularly when the recess 38 is already to be pre-formed, more about which is said below in connection with FIGS. 8 and 9, or may be formed by drilling or other such forming technique "in the field" as the protected membrane roof system 20 is installed. As shown in FIGS. 2 and 3, with the base 92 and vertical fastener rod 94 so positioned beneath and passing through the upper insulation board 30, the rod 94 is configured to have sufficient length to then extend through the ballast material 70 and vertically above the netting 80. As such, by forming a threaded portion 96 on the free end of the rod 94, or opposite the base 92, a mating threaded cap 98 may be threadably installed on the rod 94 so as to secure the netting 80 over the ballast material 70. Accordingly, where additional layers above the upper insulation board 30 such as the illustrated drainage retention layer 60 and filter fabric layer 62 are also employed in the system 20, the rod 94 must thus pass through such layers as well, with any necessary holes therein being formed in the normal course during installation. In the exemplary embodiment, the base 92 of the fastener assembly 90 is substantially annular with a nominal diameter of approximately six inches (6"), the rod is roughly one-quarter inch (¼") diameter, and the threaded cap 98 is also substantially annular with a nominal diameter of approximately four inches (4"). Such components may be made of any suitable metal (e.g., steel or aluminum), plastic (e.g., polyurethane or polyethylene), or other such material now known or later developed. It will be appreciated by those skilled in the art that any such fastener assemblies and components of any such geometrical configuration and material now known or later developed as suitable for a particular PMR context may be employed without departing from the spirit and scope of the invention.

With further reference to FIGS. 1 and 2, in terms of the spacing of the fastener assemblies 90 within the overall protected membrane roof system 20, it is contemplated that one fastener 90 per two foot by eight foot (2'×8') insulation board 30 would be sufficient, though closer spacing of the fasteners 90 (more fasteners per board) is possible to suit a particular application, as shown in FIGS. 1 and 2. Specifically, where two fasteners 90 are to be employed per board 30, in the interest of having substantially even spacing of the fasteners 90 throughout the system 20 and none of the fasteners too close to an edge of a board, the fasteners 90 would be about four feet (4') apart, or two feet (2') from each short edge, so as to maintain the overall roughly four-foot spacing over the entire system 20, even between fasteners 90 on adjacent boards. It will be appreciated that in some contexts even more fastener assemblies 90 per board 30 may be employed. Preferably all such fasteners 90 are located at least one foot (1') from any board edge, but this is not necessarily critical in all applications and certainly is not critical to the spirit and scope of the present invention. Moreover, with the netting 80 typically provided in nominal four-foot (4') or eight-foot (8') widths, such fastener spacing enables alternate fasteners 90 to be positioned along overlapping seams between adjacent sections of netting 90, thereby helping to further secure the netting 80 in position. Such netting 80 as contemplated herein may be any suitable plastic netting material now known or later developed and used in the art, including in some "garden roof" applications erosion control blankets (combination of woven plastic netting and coconut weave mesh or just mesh). In most cases, the netting 80 is utilized substantially from the roof edge to a point about eight feet (8') inbound, while in other cases such as the exemplary protected membrane roof system 20 shown in FIG. 1, the netting 80 is utilized over the entire roof. Those skilled in the art will appreciate that all such variations in the configuration of the netting 80 and the number and positioning of the fastener assemblies 90 are primarily dictated by the configuration of the building, including its parapet, if any, the type of roof and ballast material to be employed, applicable laws and regulations concerning wind uplift resistance requirements, the specifications of the owner or installer, and other factors, such that once more the exemplary protected membrane roof system 20 is to be understood as merely illustrative of features and aspects of the present invention and so is expressly non-limiting. On information and belief, a system 20 employed according to aspects of the present invention such as shown in FIGS. 1 and 2 may achieve wind uplift resistance of two hundred pounds (200 lbs) or more when employed with comparable ballast material 70, which in the case of soil can vary from typically four to eight inches (4-8") in depth depending on the plants utilized and other factors, or thus from about fifteen to twenty-two pounds per square foot (15-22 lbs/ft$^2$) installed. Those skilled in the art will thus appreciate that by installing the fastener assemblies 90 beneath the upper insulation board 30 as shown in FIG. 2, and so taking advantage of the excellent flexural strength of the foam or other such material from which the insulation board 30 is formed, which boards typically have a thickness of at least two inches (2"), the force to pull out the fastener assemblies 90 or otherwise tear or blow away the netting 80, and thus the effective wind uplift resistance of the resulting overall protected membrane roof system 20 of the present invention is thereby greatly enhanced.

Turning next to FIG. 4, there is shown a cross-sectional schematic analogous to FIG. 2 of a second exemplary embodiment of the protected membrane roof system 20 of the present invention here employing a stone ballast material 72. As in the first exemplary embodiment of FIG. 2, the protected membrane roof system 20 is shown as again generally comprising over the roof decking R, from bottom to top, a waterproofing membrane 50, a lower insulation board 40, an upper insulation board 30, a filter fabric layer 62, here stone ballast material 72, and netting 80, with the drainage retention layer 60 (FIG. 2) here not being employed. An at least one fastener assembly 90 is again provided having a base plate 92 seated beneath the upper insulation board 30 with its rod 94 extending upwardly therethrough and through the filter fabric layer 62 and the stone ballast material 72 and netting 80 for securing the netting 80 thereover. It will be appreciated that in typical stone ballasted PMR systems the layer of stone is not as thick as that of soil, rendering the overall thickness of the system 20 in a stone ballast context not as great as with soil. However, even with the fastener assembly 90 seated once more in the same location within the system 20, namely, with the base 92 between the upper and lower insulation boards 30, 40, it is yet desirable that the retention cap 98 is still positioned substantially adjacent the netting 80 for proper securement. In one embodiment, then, the rod 94 may be selectively shortened to an overall length such that the cap 98 is properly positioned as by simply cutting or trimming the rod 94 at a desired location, noting that the threaded portion 96 is sufficiently long to accommodate such a shortening of the rod 94 and still have threads remaining for engagement of the cap 98 in that particular exemplary method. Or, in an alternative embodiment, the fastener assemblies 90 may simply be produced with rods 94 of varying lengths and the appropriate such fastener assemblies 90 selected for a particular PMR installation ahead of time knowing the ballast material that is to be employed. Relatedly, where the base 92 and rod 94 are integral, such effective sub-assemblies would be substituted depending on the desired length of the rod 94; whereas, in a still further embodiment in which the base 92 and rod 94 are not integral, as by also being threadably engaged, for example, it will be appreciated that rods 94 of varying lengths can thus be substituted one for the other as needed to suit a particular application. In a still further example, the same fastener assemblies 90 may be employed for all jobs, including a single rod length and, rather than being cut or trimmed, the engagement hole in the cap 98 may go completely therethrough so that the rods 94 can do the same and the cap 98 thus be positioned at a wider variety of heights along the rod 94. Relatedly, it will be appreciated by those skilled in the art that while particular rod 94 and cap 98 configurations are shown and described herein as involving a threaded engagement, the invention is not so limited, but instead may involve a number of other engagement or fastening means now known or later developed without departing from the spirit and scope of the invention. In the alternative illustrative embodiment wherein stone ballast material 72 is employed, such may be selected, for example, as ASTM #5 gradation, ASTM #4 gradation, or ASTM #2 gradation crushed stone or washed riverbed stone applied at between ten and twenty pounds per square foot (10-20 lbs/ft$^2$), though once more it will be appreciated that a variety of other such ballast materials now know or later developed may be employed in the protected membrane roof system 20 of the present invention without departing from its spirit and scope.

Referring now briefly to FIG. 5, there is shown an alternate third embodiment similar to that of FIG. 4 wherein once again stone ballast material 72 is employed in the protected membrane roof system 20. Essentially, the one difference is that the waterproof membrane 50 is now positioned between the upper and lower insulation boards 30, 40 rather than beneath the lower insulation board 40 immediately adjacent the roof decking R as in the other embodiments herein. This is simply to illustrate as stated previously that the various layers within the overall protected membrane roof system 20 may be changed, added or removed without departing from the spirit and scope of the invention. For example, then, though a waterproof membrane 50 is now positioned between the upper and lower insulation boards 30, 40, a second such membrane 50 could still be positioned beneath the lower insulation board 40 over the roof decking R as well—any such membranes may be the same or different and single ply or multi-ply depending on the application. Moreover, it will be appreciated regarding placement of such a membrane 50 between the insulation boards 30, 40 as shown in FIG. 5, or immediately adjacent particularly the upper board bottom surface 34 (FIG. 3), that by having the base 92 of the fastener assembly 90 embedded within the upper board bottom surface 34 as by a pre-formed bottom recess 38 or otherwise, the base 92 is thus not likely to interfere with, damage, or otherwise adversely affect the waterproof membrane 50.

Turning next to the cross-sectional schematic view of FIG. 6, there is shown a fourth exemplary embodiment of the protected membrane roof system 20 of the present invention wherein now paver ballast material 74 is employed. Here, the overall system 20 is otherwise analogous to the initial stone ballast exemplary embodiment of FIG. 4 wherein the waterproof membrane 50 is again directly over the roof decking R and there is no drainage retention layer 60 (FIG. 2), though it will be appreciated once more that additionally or instead a single ply or other such membrane may be employed between the insulation boards 30, 40. As shown in FIG. 6, each such paver 74 is to be positioned over the upper insulation board 30 and any fabric filter 62 or other such layer employed in the system 20 so as to be substantially square and abutting adjacent pavers 74, except that as also shown the fastener assemblies 90 are to be positioned within the upper insulation board 30 such that the rods 94 extend between adjacent pavers 74 rather than having to pass through a paver 74. In the exemplary embodiment, the pavers 74 are formed of concrete and are roughly two foot by two foot square and two inches thick (2'×2'×2") so that it will be appreciated that with the typical four-foot (4') or eight-foot (8') spacing between fastener assemblies 90 they would thus be positioned each second or fourth paver 74, respectively. It will be further appreciated that any other spacing of the fasteners 90 so long as in two-foot (2') increments would accommodate the exemplary pavers 74 and position the fasteners 90 therebetween, and further that a variety of other paver sizes may be employed with the fasteners 90 simply spaced accordingly.

Referring now to FIG. 7, there is shown a cross-sectional schematic view of a fifth exemplary embodiment of the protected membrane roof system 20 wherein now a further insulation ballast material 76 is employed. For purposes of illustration, the overall system 20 is once again shown as in FIGS. 4 and 6 wherein the waterproof membrane 50 is directly over the roof decking R and there is no drainage retention layer 60 (FIG. 2), with the filter fabric 62, though still shown in FIG. 7, being particularly optional in conjunction with such insulation ballast material or panels 76. Here, analogous to the fourth exemplary embodiment of FIG. 6 wherein paver ballast material 74 is used, the insulation ballast material 76 in the exemplary embodiment of FIG. 7 is two foot by four foot (2'×4') concrete-faced Styrofoam® insulation (such as manufactured and sold under the name Lightguard®), the panels 76 having either a nominal two inch (2") or three inch (3") thick Styrofoam® insulation with a nominal three-eighths inch (⅜") thick latex modified concrete face, the details of which are not shown in FIG. 7 and are beyond the scope of the present invention. Again, virtually any comparable panel or board now known or later developed may be employed so as to again be laid substantially square and abutting adjacent panels 76 so as to serve as a ballast within the PMR system 20, with the fastener assemblies 90 once more preferably positioned within the upper insulation board 30 such that the rods 94 extend between adjacent ballasting panels 76 rather than having to pass through a panel 76. Here, with the panels 76 being a nominal two foot by four foot (2'×4'), it will again be appreciated that with the typical four-foot (4') or eight-foot (8') spacing between fastener assemblies 90 they would thus be positioned between each panel or at each second or fourth panel 76, respectively, depending on the number and spacing of the fasteners 90 and the orientation of the panels 76. It will be further appreciated that any other spacing of the fasteners 90 so long as in four-foot (4') increments in one direction would accommodate the exemplary panels 76 and position the fasteners 90 therebetween, it being noted that the exemplary Lightguard® insulation panels 76 are formed with tongue and groove long edges, making it further preferable in that particular embodiment to space the fasteners at least every four feet (4') in the panel lengthwise direction so as to position them only along the short edges thereof and so not interfere with the tongue-and-groove joints on the long edges. Again, a variety of other panel or insulation board sizes may be employed, with the fasteners 90 simply spaced accordingly.

Figure 8:
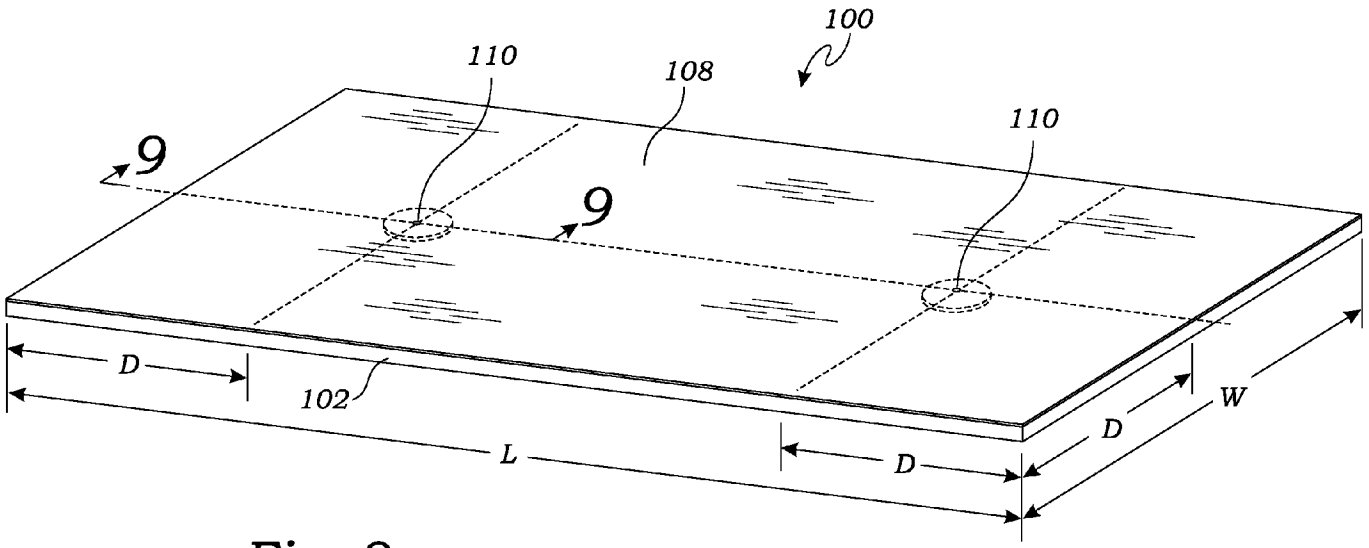
FIG. 8 is a perspective view of an exemplary insulation board employed in a protected membrane roof system according to aspects of the present invention.
Figure 9:
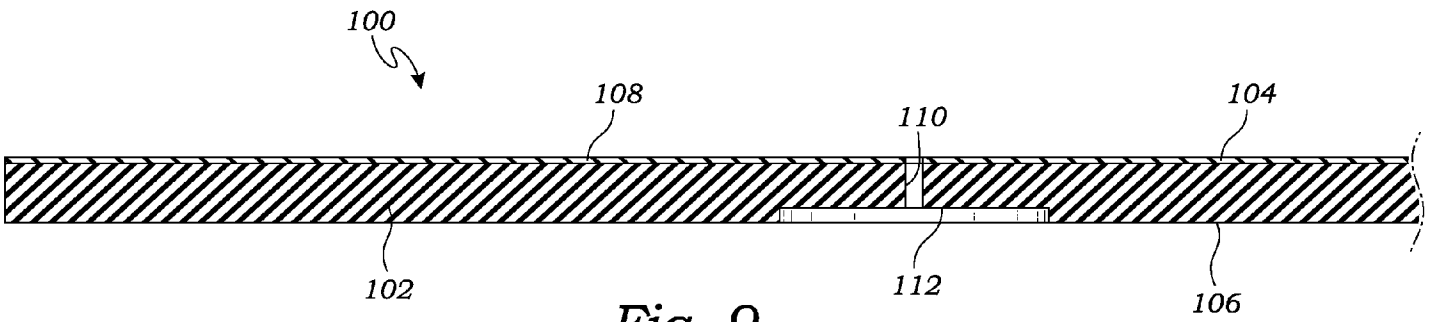
FIG. 9 is an enlarged partial cross-sectional schematic of the exemplary insulation board taken along line 9-9 of FIG. 8.

With reference now to FIGS. 8 and 9, there is shown an exemplary pre-fabricated insulation board 100 according to aspects of the present invention having a basic insulation layer 102 formed of an extruded polystyrene foam or the like of a nominal two to six inch (2-6") thickness; again, any appropriate material now known or later developed may be employed in a variety of thicknesses without departing from the spirit and scope of the invention. In the illustrated embodiment, the pre-fabricated insulation board 100 is formed with two holes 110 to accommodate fastener assemblies 90 such as shown in FIGS. 2-7, though again it will be appreciated that any number of fasteners 90 and thus holes 110 may be employed and that even if multiple holes 110 are pre-formed in the insulation board 100, not all holes 110 need be used. With the exemplary board 100 having a nominal length L of eight feet (8') and a nominal width W of four feet (4'), the holes 110 are thus positioned in the board 100 so as to be a distance D of two feet (2') from each long edge and from the respective short edge. As a result, the two holes 110 on a single board 100 are substantially four feet (4') apart as are each hole 110 from the closest hole on an adjacent board forming part of an overall protected membrane roof system 20 according to aspects of the invention as shown in FIG. 1. Furthermore, at the base of the through-hole 110, or in the insulation layer bottom surface 106, a relatively larger diameter recess 112 may be pre-formed so as to accommodate the base 92 of a later-inserted fastener assembly 90 as shown particularly in FIG. 3. It will be appreciated that by pre-forming such through-hole 110 and optional recess 112 the installation of the boards 100 in the field, and particularly the installation of fastener assemblies 90 therewith, is made easier and errors related to the proper spacing of the fasteners 90 are eliminated. As a further optional feature of the pre-fabricated insulation board 100, a polyethylene facer 108 may be applied to the insulation layer top surface 104 so as to then form the top side of the insulation board 100, though once more any other such material now known or later developed having suitable strength and water-resistance may optionally be employed within a pre-fabricated insulation board 100 according to aspects of the present invention. It will be appreciated by those skilled in the art that such a pre-fabricated insulation board 100 may be substituted for the upper insulation board 30 in any of the exemplary embodiments of the protected membrane roof system 20 as shown in FIGS. 2-7 or in any other such PMR system according to aspects of the present invention without departing from its spirit and scope.

To summarize, regarding the exemplary embodiments of the present invention as shown and described herein, it will be appreciated that a protected membrane roof system is disclosed and configured for effectively anchoring a netting positioned over a ballast material beneath an upper insulation board positioned beneath the ballast material. Because the principles of the invention may be practiced in a number of configurations beyond those shown and described, it is to be understood that the invention is not in any way limited by the exemplary embodiments, but is instead able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention. Furthermore, the various features of each of the above-described embodiments may be combined in any logical manner and are intended to be included within the scope of the present invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A protected membrane roof system for installation on a roof decking, comprising:

a plurality of upper insulation boards each having an upwardly-facing upper board top surface and an opposite downwardly-facing upper board bottom surface;

a ballast material positioned over and in close proximity to the upper insulation boards;

a netting positioned over the ballast material;

at least one fastener assembly comprising a base seated adjacent to the upper board bottom surface and configured to selectively engage the netting; and a waterproof membrane positioned over and in close proximity to the roof decking beneath and in close proximity to the upper insulation boards, the at least one fastener assembly neither penetrating nor attaching to the membrane;

whereby the wind uplift resistance of the protected membrane roof system is improved and scour of the ballast material is reduced by effectively anchoring the netting beneath the upper insulation boards positioned beneath the ballast material without compromising the waterproof membrane.

2. The system of claim 1 wherein:

at least one of the upper insulation boards has a through-hole communicating between the respective upper board top and bottom surfaces;

the at least one upper insulation board is further formed on the upper board bottom surface with a downwardly-opening recess concentric with the through-hole; and the free-floating base of the fastener assembly is seated within the recess.

3. The system of claim 2 wherein the at least one upper insulation board is formed having two spaced-apart through-holes.

4. The system of claim 1 further comprising a plurality of lower insulation boards each having an upwardly-facing lower board top surface and an opposite downwardly-facing lower board bottom surface, the lower insulation boards positioned beneath the upper insulation boards.

5. The system of claim 4 wherein the waterproof membrane is installed directly over the roof decking so as to be beneath the lower insulation boards, whereby the base of the fastener assembly is separated from the membrane by the respective lower insulation board.

6. The system of claim 4 wherein the waterproof membrane is installed between the upper insulation boards and the lower insulation boards.

7. The system of claim 1 further comprising a filter fabric layer between the upper insulation boards and the ballast material.

8. The system of claim 1 wherein the ballast material is soil.

9. The system of claim 8 further comprising a semi-rigid drainage retention layer between the upper insulation boards and the soil ballast material.

10. The system of claim 9 further comprising a filter fabric layer between the drainage retention layer and the ballast material.

11. The system of claim 1 wherein the ballast material is stones.

12. The system of claim 1 wherein the ballast material is pavers.

13. The system of claim 12 wherein the at least one fastener assembly is positioned such that a rod connected to the base of the fastener assembly extends vertically between adjacent pavers.

14. The system of claim 1 wherein the ballast material is insulation panels.

15. The system of claim 14 wherein the at least one fastener assembly is positioned such that a rod connected to the base of the fastener assembly extends vertically between adjacent panels.

16. The system of claim 14 wherein:

the panels are a nominal two foot by four foot (2'×4'); and two fastener assemblies are installed within two through-holes formed in the respective at least one upper insulation board spaced approximately four feet (4') apart such that the fastener assemblies extend between each lengthwise panel.

17. The system of claim 1 wherein the ballast material is immediately adjacent to the upper board top surface.

18. A protected membrane roof system for installation on a roof decking, comprising:

a plurality of lower insulation boards each having an upwardly-facing lower board top surface and an opposite downwardly-facing lower board bottom surface, the lower insulation boards positioned over and in close proximity to the roof decking;

a plurality of upper insulation boards each having an upwardly-facing upper board top surface and an opposite downwardly-facing upper board bottom surface, at least one of the upper insulation boards having a through-hole communicating between the respective upper board top and bottom surfaces, the upper insulation boards positioned over and in close proximity to the lower insulation boards;

a ballast material positioned over and in close proximity to the upper insulation boards;

a netting positioned over the ballast material;

at least one fastener assembly comprising a base seated adjacent the at least one upper insulation board bottom surface; and a waterproof membrane positioned above and in close proximity to the roof decking, the at least one fastener assembly neither penetrating nor attaching to the membrane;

whereby the wind uplift resistance of the protected membrane roof system is improved and scour of the ballast material is reduced by effectively anchoring the netting beneath the upper insulation boards positioned beneath the ballast material without compromising the waterproof membrane.

19. The system of claim 18 wherein the waterproof membrane is installed directly over and immediately adjacent the roof decking so as to be beneath the lower insulation boards, whereby the base of the fastener assembly is separated from the membrane by the respective lower insulation board.

20. The system of claim 18 wherein the waterproof membrane is installed between the upper insulation boards and the lower insulation boards so as to be immediately adjacent the respective lower board top surface.

21. A protected membrane roof system for installation on a roof decking, comprising:

a plurality of lower insulation boards each having an upwardly-facing lower board top surface and an opposite downwardly-facing lower board bottom surface, the lower insulation boards positioned over the roof decking;

a plurality of upper insulation boards each having an upwardly-facing upper board top surface and an opposite downwardly-facing upper board bottom surface, the upper insulation boards positioned over the lower insulation boards, the upper and lower insulation boards being comprised of foam;

a ballast material positioned over the upper insulation boards;

a netting positioned over the ballast material;

at least one fastener assembly comprising:

a base seated adjacent the at least one upper insulation board bottom surface;

a rod extending vertically from the base of sufficient size so as to extend through the ballast material and the netting; and a cap engaged with the rod above the netting; and a waterproof membrane installed directly over and immediately adjacent the roof decking so as to be beneath the lower insulation boards, whereby the at least one fastener assembly neither penetrates nor contacts the membrane, the base of each fastener assembly being separated from the membrane by the respective lower insulation board;

whereby the wind uplift resistance of the protected membrane roof system is improved and scour of the ballast material is reduced by effectively anchoring the netting beneath the upper insulation boards positioned beneath the ballast material without compromising the waterproof membrane.

* * * * *